US012157962B2

(12) United States Patent
Watanabe

(10) Patent No.: US 12,157,962 B2
(45) Date of Patent: Dec. 3, 2024

(54) SEWING MACHINE

(71) Applicant: JUKI CORPORATION, Tama (JP)

(72) Inventor: Takashi Watanabe, Tama (JP)

(73) Assignee: JUKI CORPORATION, Tama (JP)

( * ) Notice: Subject to any disclaimer, the term of this patent is extended or adjusted under 35 U.S.C. 154(b) by 51 days.

(21) Appl. No.: 18/083,800

(22) Filed: Dec. 19, 2022

(65) Prior Publication Data

US 2023/0193539 A1 Jun. 22, 2023

(30) Foreign Application Priority Data

Dec. 21, 2021 (JP) ..... 2021-207001

(51) Int. Cl.
*D05B 27/06* (2006.01)
*D05B 57/10* (2006.01)
*D05B 29/06* (2006.01)

(52) U.S. Cl.
CPC ..... *D05B 27/06* (2013.01); *D05B 57/10* (2013.01); *D05B 29/06* (2013.01)

(58) Field of Classification Search
CPC ..... D05B 27/06; D05B 27/00; D05B 27/02; D05B 27/08; D05B 57/10; D05B 29/06
See application file for complete search history.

(56) References Cited

U.S. PATENT DOCUMENTS 2,470,931 A * 5/1949 Jennings ..... D05B 51/00 112/260
2,633,816 A * 4/1953 Johnson ..... D05B 27/02 112/260
3,416,473 A * 12/1968 Peterson ..... D05B 27/08 112/235
3,527,183 A * 9/1970 Szostak ..... D05B 27/02 112/323
3,921,552 A * 11/1975 Daman ..... D05B 27/02 112/323

(Continued)

FOREIGN PATENT DOCUMENTS

DE 102016102024 A1 * 8/2016 ..... D05B 65/02
DE 11 2016 001 740 T5 12/2017

(Continued)

OTHER PUBLICATIONS

Extended European Search Report issued May 30, 2023 in Application No. 22214956.9.

*Primary Examiner* — Ismael Izaguirre
(74) *Attorney, Agent, or Firm* — Faegre Drinker Biddle & Reath LLP

(57) ABSTRACT

A sewing machine includes a feed dog partially protruding out up and down from a throat plate to feed a workpiece, a sewing needle configured to perform stitch points on the workpiece by moving up and down, and a shuttle configured to capture an upper thread passed through the sewing needle below the throat plate to be entwined with a lower thread. The feed dog includes a top plate having teeth formed on an upper surface thereof, and a support portion to which a feed operation relative to the top plate is input. The top plate includes an insertion hole that the sewing needle penetrates up and down, and a pair of wall portions extending in an up-and-down direction respectively on one side and another side in a feed direction of the workpiece relative to the insertion hole on a lower surface side of the top plate.

5 Claims, 11 Drawing Sheets

(56) References Cited

U.S. PATENT DOCUMENTS

| | | | | |
|---|---|---|---|---|
| 4,926,770 | A * | 5/1990 | Hanyu | D05B 55/06 112/260 |
| 2018/0112341 | A1 | 4/2018 | Tokuda et al. | |

FOREIGN PATENT DOCUMENTS

| | | | | | |
|---|---|---|---|---|---|
| EP | 2 138 619 | A1 | | 12/2009 | |
| JP | 2004-174120 | A | | 6/2004 | |
| JP | 2008068005 | A | * | 3/2008 | D05B 65/02 |
| JP | 4913575 | B2 | | 4/2012 | |

* cited by examiner

SEWING MACHINE

CROSS-REFERENCE TO RELATED APPLICATIONS

The present application claims the benefit of priority of Japanese Patent Application No. 2021-207001, filed on Dec. 21, 2021, the content of which is incorporated herein by reference.

TECHNICAL FIELD

The present invention relates to a sewing machine including a feed dog.

BACKGROUND

In a sewing machine including a feed dog in the related art, when an upper thread is captured by a shuttle and drawn below a throat plate, a loop of the upper thread formed by the shuttle may go into disorder until the upper thread is drawn up by a thread take-up lever. As a result, the loop of the upper thread may be caught on a corner portion of a top plate of the feed dog and cause a sewing failure.

In a sewing machine described in Japanese Patent No. 4913575, a corner portion of a top plate of a feed dog is rounded in an arc shape to reduce catching of a loop of an upper thread, thereby solving the above problem.

SUMMARY

However, in the sewing machine described in Japanese Patent No. 4913575, when the corner portion of the top plate of the feed dog is rounded, the contact area between an upper surface of a throat plate and a workpiece is reduced, and the stable feeding of the workpiece may be affected.

An object of the present embodiment is to form excellent seams while feeding a workpiece well.

An aspect of the present embodiment is a sewing machine comprising:

- a feed dog partially protruding out up and down from a throat plate to feed a workpiece;
- a sewing needle configured to perform stitch points on the workpiece by moving up and down; and
- a shuttle configured to capture an upper thread passed through the sewing needle below the throat plate to be entwined with a lower thread,
- wherein the feed dog includes a top plate having teeth formed on an upper surface thereof, and a support portion to which a feed operation relative to the top plate is input, and
- wherein the top plate includes an insertion hole that the sewing needle penetrates up and down, and a pair of wall portions extending in an up-and-down direction respectively on one side and another side in a feed direction of the workpiece relative to the insertion hole on a lower surface side of the top plate.

As described above, according to the present embodiment, the wall portion of the feed dog prevents a loop of the upper thread from going into disorder. Accordingly, it is not necessary to cut a corner portion of the top plate, and excellent seams can be formed while the workpiece is fed well.

DESCRIPTION OF EMBODIMENTS

Embodiments of the Invention

Hereinafter, an embodiment of the present invention will be described with reference to the drawings. The following description is an embodiment of the present invention and does not limit the present invention.

Figure 1:
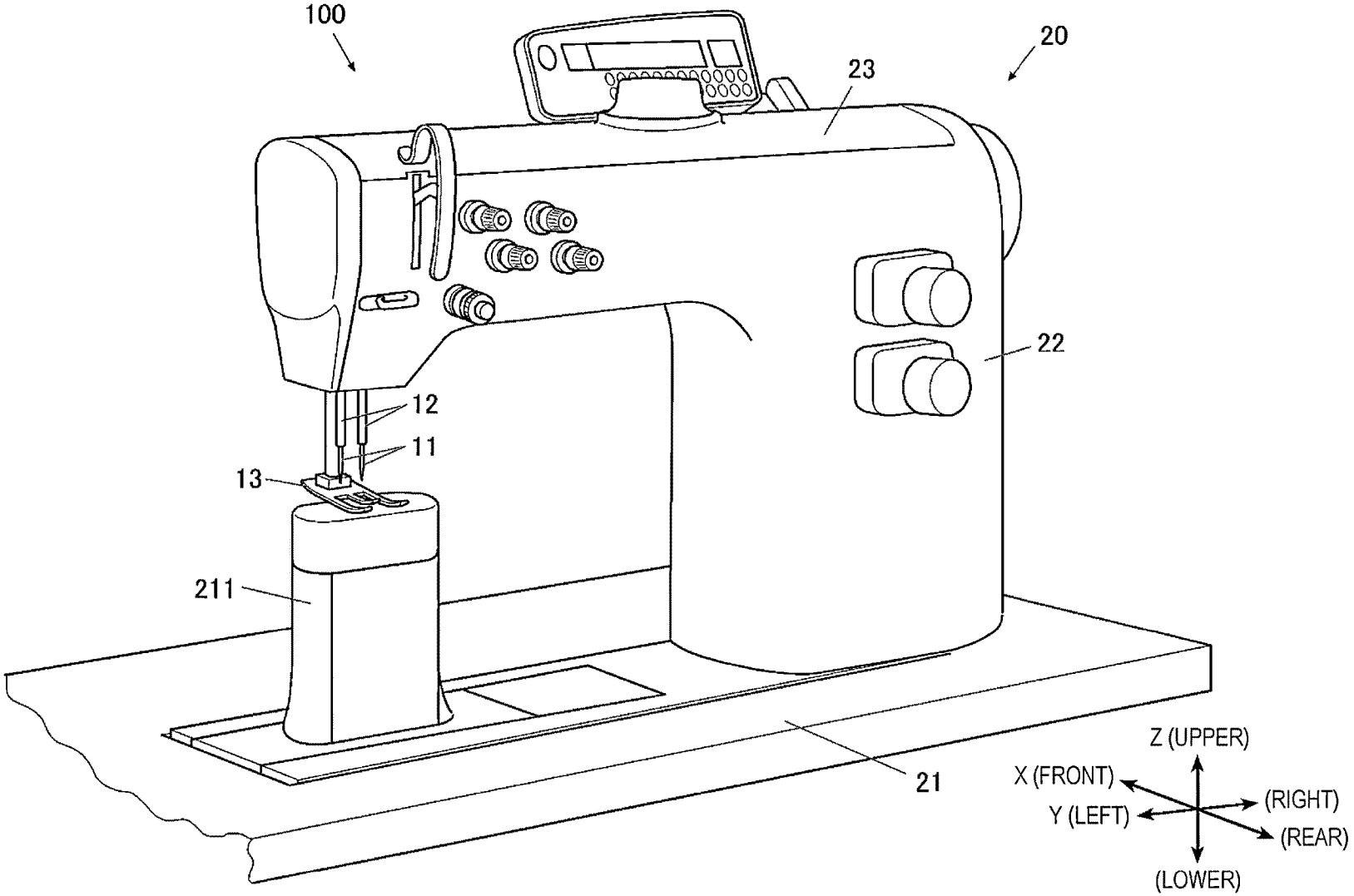
FIG. 1 is a perspective view illustrating an overall configuration of a sewing machine according to an embodiment of the present invention.
Figure 2:
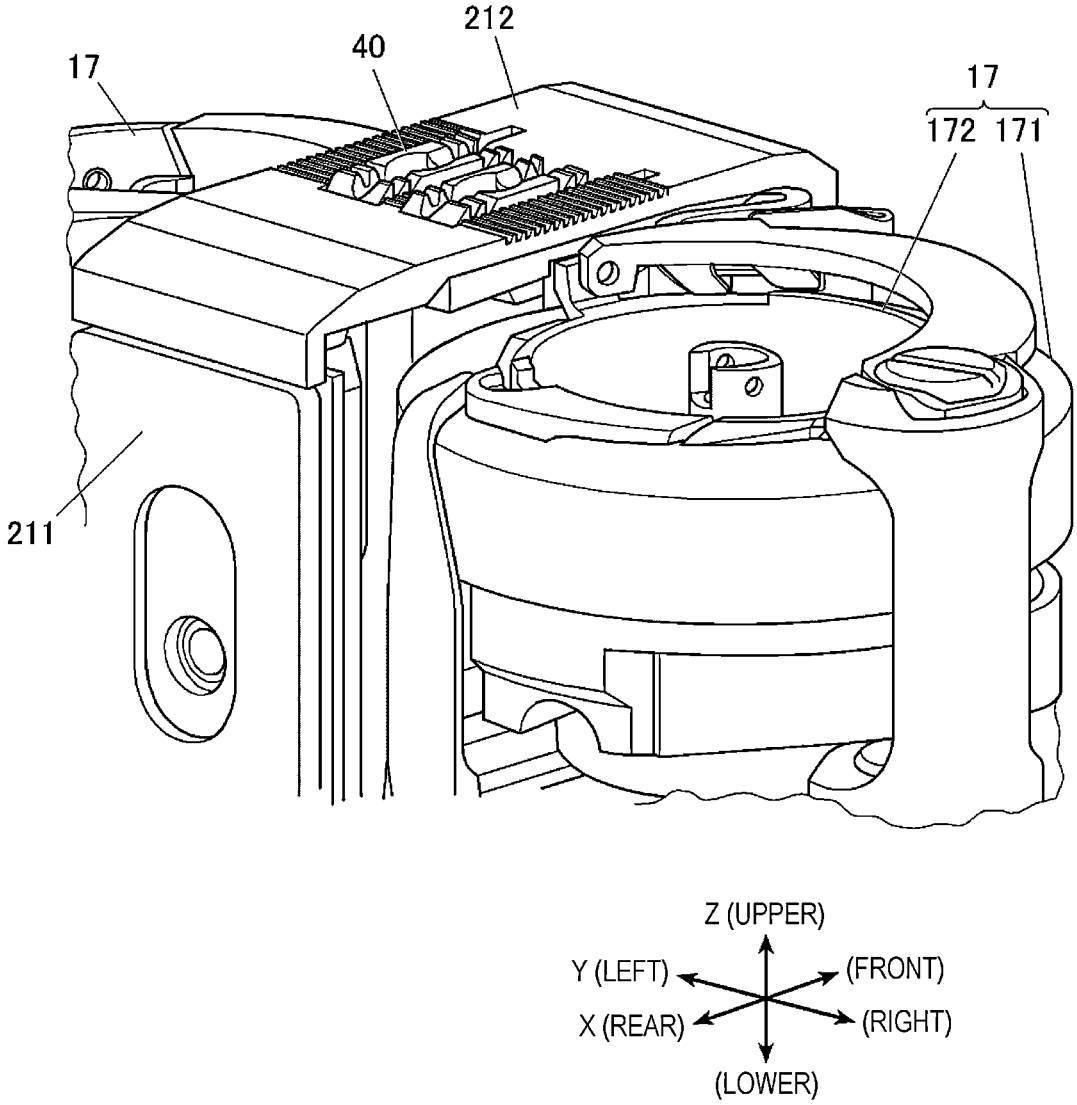
FIG. 2 is an enlarged perspective view illustrating a configuration in the vicinity of a throat plate.

FIG. 1 is a perspective view of a sewing machine 100 according to the present embodiment. FIG. 2 is an enlarged perspective view illustrating a configuration in the vicinity of a throat plate 212, which will be described later.

In the present embodiment, a post-bed unison-feed sewing machine, which is a double-needle sewing machine and includes a horizontal shuttle, is described as an example of the sewing machine 100.

To implement the present invention, none of double-needle, unison-feed, the horizontal shuttle, and post-bed are necessary and these are only preferred examples.

The sewing machine 100 includes a needle up-and-down movement mechanism that moves up and down two needle bars 12 each holding a sewing needle 11 at lower end portions, a feed mechanism that feeds a workpiece in a predetermined feed direction (X-axis direction described later) by a feed dog 40 (see FIG. 2) from below the throat plate 212 (described later), an upper feed mechanism that feeds the workpiece on the throat plate 212 in the feed direction (X-axis direction) by a feed foot 14 (see FIG. 3) from above, a needle-feed mechanism that feeds the sewing needles 11 in the feed direction (X-axis direction) of the workpiece, a feed adjustment mechanism that adjusts a sewing pitch, a shuttle mechanism including two horizontal shuttles 17, and a sewing machine frame 20 holding these components. Each of the above-described mechanisms has a known configuration in a sewing machine, and thus description thereof will be simplified.

The sewing machine 100 also has a general configuration for a sewing machine such as a thread tensioner and a thread take-up lever, and description thereof will be omitted since the configuration is known.

[Sewing Machine Frame]

The sewing machine frame 20 includes a sewing machine bed portion 21, an upright body portion 22, and a sewing machine arm portion 23.

The sewing machine bed portion 21 is located at a lower portion of the sewing machine frame 20 and supports the entire sewing machine frame 20. The sewing machine bed portion 21 extends along a Y-axis direction described later, and includes a post bed 211 erected on an upper surface of one end portion thereof and the throat plate 212 (see FIG. 2) on which stitch points are performed on an upper end surface of the post bed 211.

The upright body portion 22 is erected from the other end portion of the sewing machine bed portion 21. The sewing machine arm portion 23 extends from an upper end portion of the upright body portion 22 in the same direction as the sewing machine bed portion 21 along the Y-axis direction.

The sewing machine arm portion 23 supports the needle bars 12, a presser foot 13, and the feed foot 14 at a lower portion of a distal end thereof in the extending direction.

In the following description, a longitudinal direction of the sewing machine bed portion 21 parallel to the upper surface of the sewing machine bed portion 21 is referred to as the Y-axis direction, a direction parallel to the upper surface of the sewing machine bed portion 21 and orthogonal to the Y-axis direction is referred to as the X-axis direction, and a direction perpendicular to the upper surface of the sewing machine bed portion 21 is referred to as a Z-axis direction. As illustrated in FIG. 1, one side in the Y-axis direction is defined as "left", the other side is defined as "right", one side in the X-axis direction is defined as "front", the other side is defined as "rear", one side in the Z-axis direction is defined as "upper", and the other side is defined as "lower". Downstream of the workpiece in the feed direction is referred to as "front".

The sewing machine 100 normally performs sewing with the sewing machine frame 20 installed such that the X-axis direction and the Y-axis direction are horizontal and the Z-axis direction is the vertical direction.

Directions of components of the sewing machine 100 will be described on these premises.

[Needle Up-and-Down Movement Mechanism]

The needle up-and-down movement mechanism applies a reciprocating up-and-down movement to the two needle bars 12, which are adjacent in the Y-axis direction, via a crank mechanism from an upper shaft that rotates by using a sewing machine motor (not illustrated) as a drive source. The thread take-up lever is assembled into the needle up-and-down movement mechanism and pivots reciprocally in synchronization with the needle bars 12.

[Needle-Feed Mechanism]

The needle-feed mechanism includes a needle bar oscillating base that supports the two needle bars 12 to be movable up and down and is supported to be oscillatory about a Y axis in the sewing machine arm portion 23, and a power mechanism that applies reciprocating oscillation to the needle bar oscillating base using the sewing machine motor as a drive source. When the needle bar oscillating base oscillates about the Y axis, the sewing needles 11 located at the lower end portions of the needle bars 12 reciprocate in the X-axis direction.

The power mechanism obtains power of the reciprocating movement from the sewing machine motor via a feed mechanism described later, thereby synchronizing the feed oscillation of the sewing needles 11 and the feed movement of the feed dog.

The sewing needles 11 perform a revolving movement about the Y axis by combining the reciprocating movement in the X-axis direction by the needle-feed mechanism and the reciprocating up-and-down movement by the needle up-and-down movement mechanism, enabling the forward feeding of the sewing needles 11 while performing stitch points on the workpiece on the throat plate 212.

[Upper Feed Mechanism]

Figure 3:
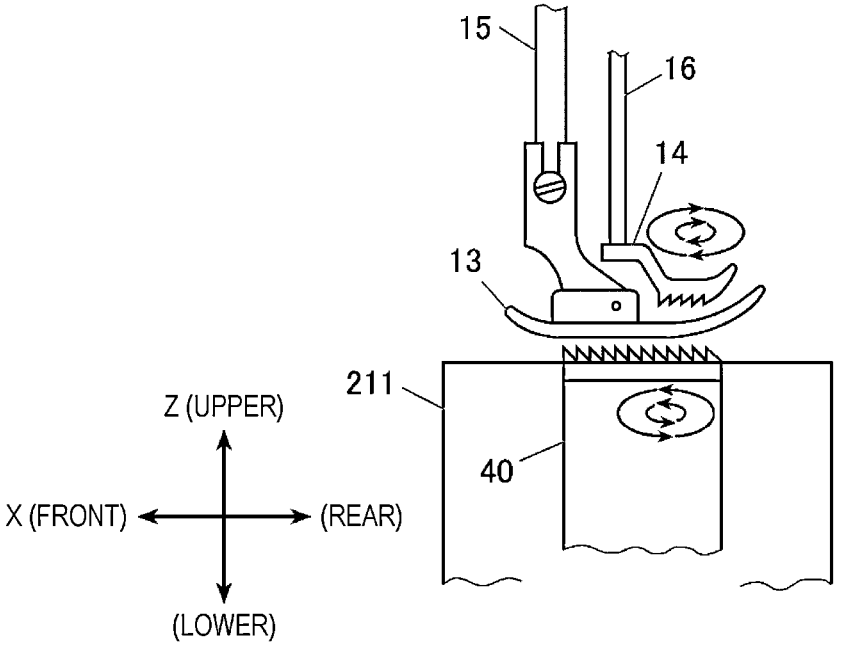
FIG. 3 is a side view schematically illustrating a configuration above and below the throat plate.

FIG. 3 is a side view schematically illustrating a configuration above and below the throat plate 212. As illustrated in FIGS. 1 and 3, the upper feed mechanism includes the presser foot 13 that presses the workpiece on the throat plate 212 from above, the feed foot 14 that feeds the workpiece forward, a presser bar 15 that supports the presser foot 13 at a lower end portion thereof, and a feed foot bar 16 that supports the feed foot 14 at a lower end portion thereof.

The upper feed mechanism further includes a triangular link to which upper end portions of the presser bar 15 and the feed foot bar 16 are coupled to be pivotable about the Y axis, a presser spring that presses the triangular link downward, and a power mechanism that applies reciprocating oscillation to the triangular link from the sewing machine motor via a cam.

The presser bar 15 is supported by the sewing machine arm portion 23 to be movable up and down, and a downward pressing force is applied to the presser bar 15 by the presser spring via the triangular link. Accordingly, the presser foot 13 applies pressing pressure from above to below to the workpiece on the throat plate 212.

On the other hand, since the triangular link is given the reciprocating oscillation, the triangular link alternately moves the presser foot 13 and the feed foot 14 up and down via the presser bar 15 and the feed foot bar 16 so that the presser foot 13 and the feed foot 14 step. Since the feed foot bar 16 is supported by the triangular link to be oscillatory about the Y axis, the workpiece is sandwiched from above and below between the feed foot 14 and the feed dog 40 when the feed foot 14 lands, and the feed foot 14 oscillates in the feed direction and feeds the workpiece. The feed foot 14 has serrated teeth formed on a bottom surface thereof to easily hold the workpiece.

[Feed Mechanism]

The feed mechanism includes the feed dog 40 whose tooth tips are seen through two openings of the throat plate 212 provided at the upper end portion of the post bed 211, and a power mechanism that applies a feed operation to the feed dog 40.

A detailed structure of the feed dog 40 will be described later.

The power mechanism takes out reciprocating movements in the X-axis direction and the Z-axis direction from the rotation of the sewing machine motor via a cam mechanism, combines the reciprocating movements in the two directions, and transmits the combined reciprocating movements to a feed dog bracket disposed below the post bed 211. The feed dog bracket is given the combined reciprocating movements in two directions of the X-axis direction and the Z-axis direction, thereby performing a revolving movement about the Y axis. The feed dog bracket transmits the revolving movement about the Y axis to the feed dog 40 disposed below the throat plate 212 via a feed lever member inserted up and down through the post bed 211.

Accordingly, the feed dog 40 can move in the feed direction and feed the workpiece on the throat plate 212 while keeping the tooth tips partially protruding out from the two openings of the throat plate 212.

[Feed Adjustment Mechanism]

The feed adjustment mechanism can adjust a reciprocating movement component (feed pitch) in the X-axis direction transmitted to the feed dog bracket by changing and adjusting a movement direction of a part of link members of a multi-joint link mechanism that transmits the reciprocating movement in the X-axis direction from the cam mechanism constituting the power mechanism of the feed mechanism to the feed dog bracket. The feed adjustment mechanism can also switch positive feed (forward feed) of the workpiece to reverse feed (backward feed).

The feed adjustment mechanism may adjust the feed pitch by manually operating an operation unit such as a dial, and may adjust the feed pitch by a motor that controls an operation amount. When the feed adjustment mechanism includes a motor, for example, the motor is controlled to have a feed pitch set and input from an operation panel.

[Shuttle Mechanism]

The shuttle mechanism is provided in the vicinity of the upper end portion of the post bed 211, and includes the two horizontal shuttles 17 arranged side by side in the Y-axis direction, and a power mechanism that transmits rotation from the sewing machine motor to the horizontal shuttles 17.

The power mechanism includes a lower shaft that extends along the Y-axis direction and rotates via a timing belt stretching in the upright body portion 22 from the upper shaft, two shuttle shafts provided in the post bed 211 along the Z-axis direction, and a gear mechanism using a bevel gear that transmits rotation from the lower shaft to the shuttle shafts. The gear mechanism accelerates the rotation of the sewing machine motor to double speed and transmits the rotation to the shuttle shafts.

The two horizontal shuttles 17 are disposed on two sides in the Y-axis direction with the feed dog 40 disposed below the throat plate 212 sandwiched in between.

Each horizontal shuttle 17 includes an outer shuttle 171 that is coupled to an upper end portion of the corresponding shuttle shaft and rotates about the Z axis, and an inner shuttle 172 that stores a bobbin of a lower thread D while maintaining a non-rotating state inside the outer shuttle 171.

During sewing, each sewing needle 11 is inserted into a corresponding one of two insertion holes 43 (see FIG. 4) provided in the feed dog 40 from above, and a hook 173 (see FIG. 6A) of the outer shuttle 171 of each horizontal shuttle 17 captures an upper thread loop from the corresponding sewing needle 11, and largely draws the loop below the throat plate 212 to pass through the inner shuttle 172. Accordingly, the lower thread D drawn out from a lower thread feed port 174 (see FIG. 6A) of the inner shuttle 172 is inserted into a loop of an upper thread U to form a knot.

[Feed Dog]

Figure 4:
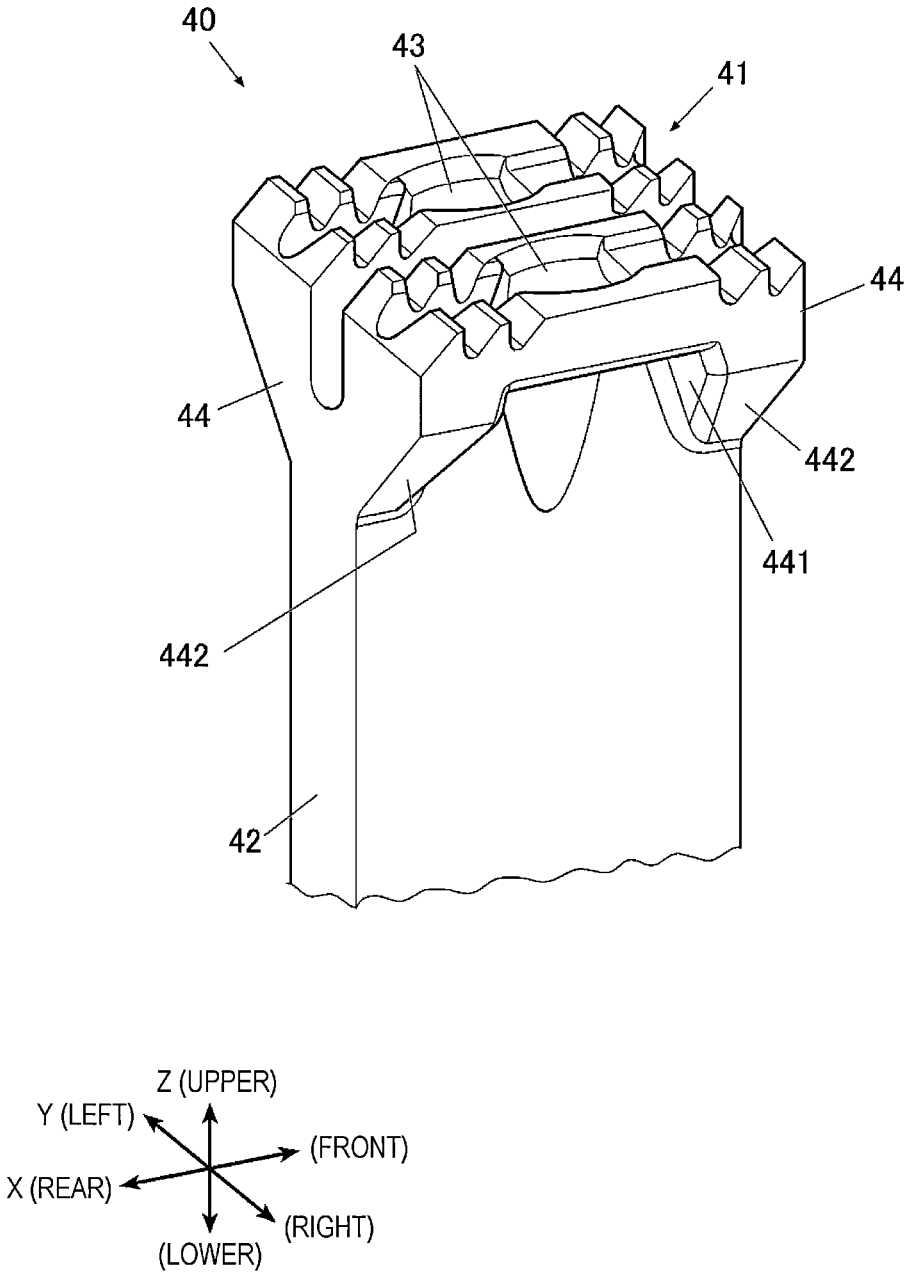
FIG. 4 is a perspective view of a feed dog.
Figure 5:
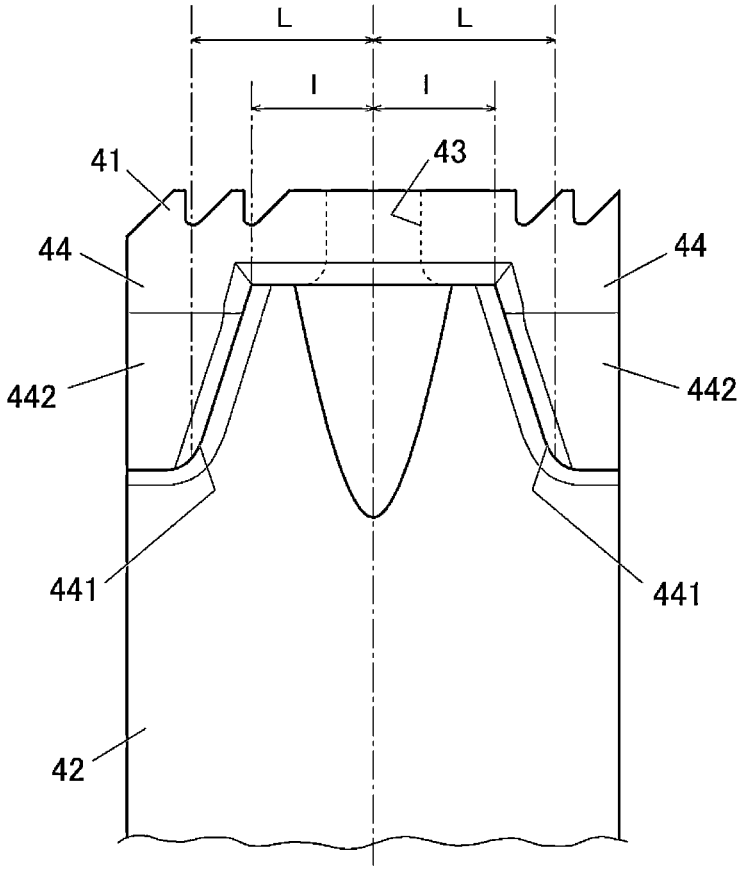
FIG. 5 is a side view of the feed dog.
Figure 5:
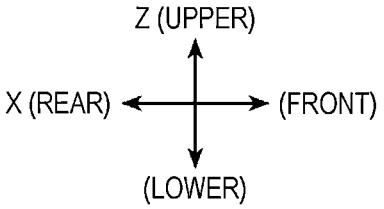

FIG. 4 is a perspective view of the feed dog 40. FIG. 5 is a side view of the feed dog 40.

The feed dog 40 includes a top plate 41 and a support portion 42 that is integrally coupled to the top plate 41 and to which a feed operation is transmitted.

The top plate 41 is a rectangular flat plate body along an X-Y plane, and the support portion 42 is a rectangular flat plate body along an X-Z plane. An upper end portion of the support portion 42 is integrally coupled to a middle portion of a lower surface of the top plate 41 in the Y-axis direction. Accordingly, when viewed from the X-axis direction, the feed dog 40 has a substantially T-shape by the top plate 41 and the support portion 42, in which the top plate 41 extends to left and right from the upper end portion of the vertically erected support portion 42.

A lower end portion of the support portion 42 is supported by an upper end portion of the feed lever member of the feed mechanism inserted up and down through the post bed 211, so that a feed operation is input to the support portion 42.

The top plate 41 is formed with a groove extending along the X-axis direction in a middle portion of an upper surface thereof in the Y-axis direction, so that the upper surface is divided into right and left two parts corresponding to the two sewing needles 11. The top plate 41 is further formed with serrated teeth as viewed in the Y-axis direction at a front end portion and a rear end portion of the upper surface. Tooth tips of the teeth are slightly inclined forward relative to a vertically upward direction, so that friction forward relative to a lower surface of the workpiece is increased.

At the middle portion of the top plate 41 in the X-axis direction, the substantially circular insertion holes 43, through which the sewing needles 11 are inserted, penetrate the top plate 41 up and down on left and right two sides with the support portion 42 sandwiched in between. The sewing needles 11 are inserted into the corresponding insertion holes 43, and the upper thread U is caught by the horizontal shuttles 17 below the throat plate 212 and the top plate 41.

The top plate 41 includes, on a lower surface side thereof, a pair of wall portions 44 extending in an up-and-down direction on one side (front side) and the other side (rear side) in the X-axis direction (feed direction of the workpiece) relative to the insertion holes 43.

The wall portions 44 each have a plate shape along a Y-Z plane. In the present embodiment, the wall portions 44 are located at a front end portion and a rear end portion of the top plate 41, and may also be close to the insertion holes 43 in the X-axis direction. One wall portion 44 is provided on the front side and one wall portion 44 is provided on the rear side for the left and right insertion holes 43 together. Alternatively, one wall portion may be provided on the front side or the rear side for each of the left and right insertion holes 43.

Each wall portion 44 has an inner side surface 441 (surface facing a lower side of the insertion hole 43) on the insertion hole 43 side, and the inner side surface 441 is inclined in a direction away from the insertion hole 43 as approaching downward.

The wall portion 44 further has, at a lower portion of each end portion (end portion separated from the support portion 42) thereof in a width direction (Y-axis direction) of the top plate 41, an inclined surface 442 that is inclined inward (toward the support portion 42) in the width direction of the top plate 41 as approaching downward. The inclined surface 442 reaches the support portion 42.

[Behaviors of Upper Thread and Lower Thread]

Behaviors of the upper thread U and the lower thread D extending from the horizontal shuttles 17 to the insertion hole 43 of the feed dog 40 in a series of hand movement and feed operation will be described with reference to the drawings. FIGS. 6A, 7A, 8A, 9A, and 10A are perspective views of the throat plate 212 and the horizontal shuttle 17, and FIGS. 6B, 7B, 8B, 9B, and 10B are cross-sectional views of the feed dog 40 as viewed from a right side.

Figure 6A:
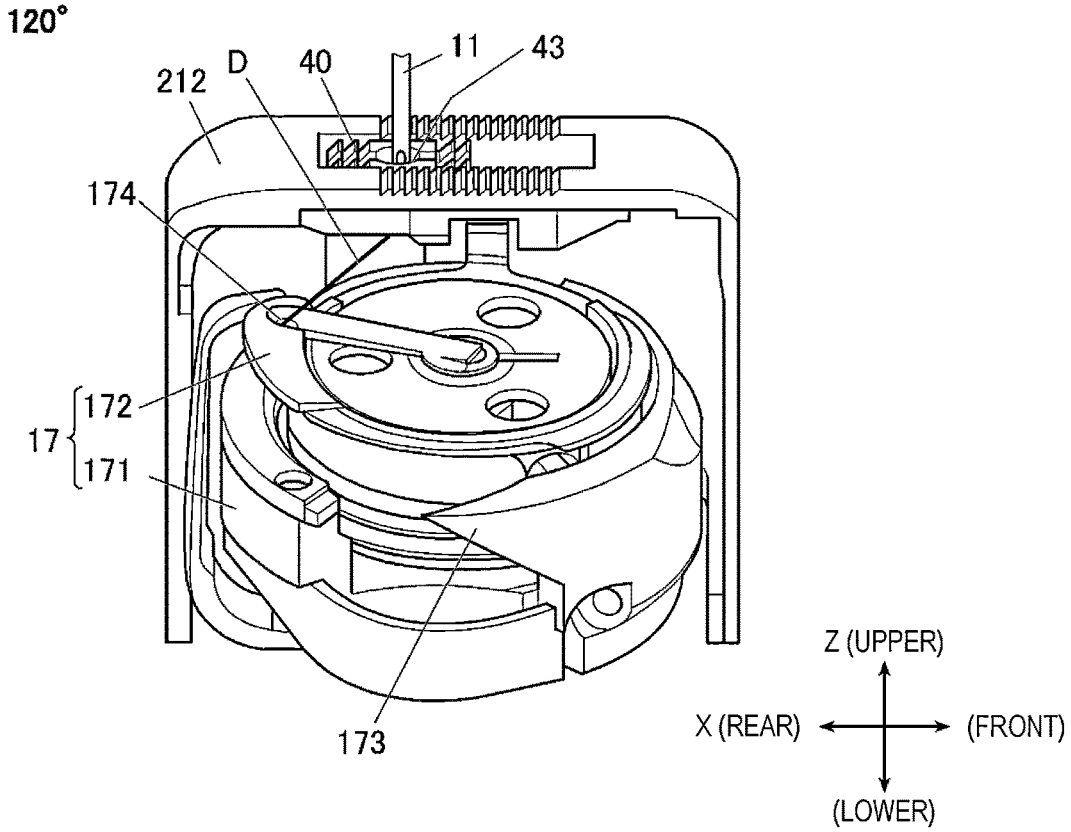
FIG. 6A is a perspective view illustrating behaviors of an upper thread and a lower thread extending from a horizontal shuttle to an insertion hole of the feed dog during sewing.
Figure 6B:
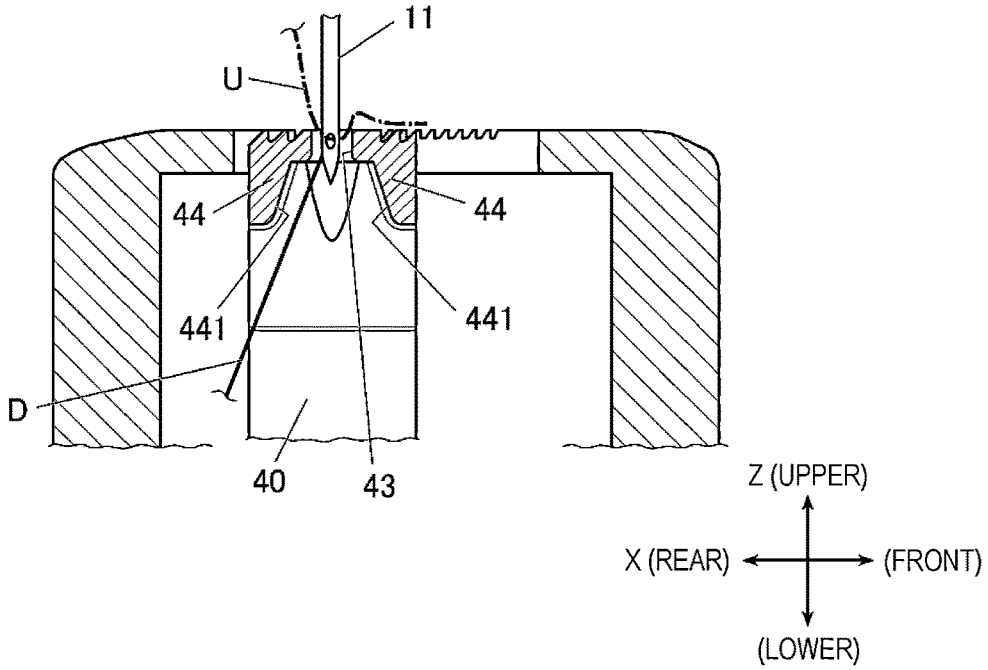
FIG. 6B is a cross-sectional view thereof as viewed from a lateral side.

The sewing needle 11 performs reciprocating up-and-down movement of one stroke and the horizontal shuttle 17 performs two rotations per rotation of the upper shaft of the needle vertical movement mechanism. When an upper shaft angle when the needle bar 12 is located at a top dead center is 0°, FIGS. 6A and 6B illustrate a state in which the upper shaft angle is 120°. The upper shaft angle of 120° is a timing at which the downward sewing needle 11 generally starts to enter the insertion hole 43, and the feed dog 40 moves upward and forward to start feeding the workpiece.

At this timing, the lower thread D extends straight from a lower thread feed port 174 to the insertion hole 43, and is not in contact with the inner side surface 441 of the feed dog 40 on the lower thread feed port 174 side.

The upper thread U is inserted into an eye hole of the sewing needle 11, and has not yet been drawn by the horizontal shuttle 17. The feed dog 40 is located in the vicinity of a rear end portion in a front and rear stroke range in the forward movement.

Figure 7A:
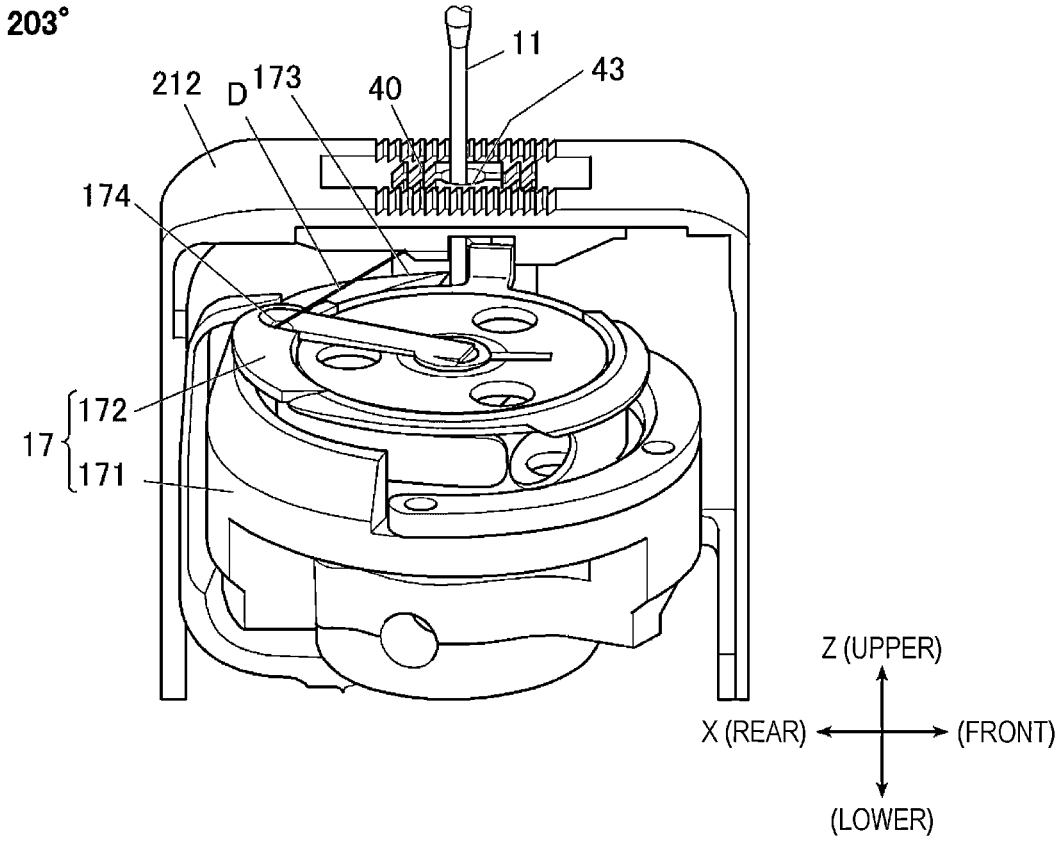
FIG. 7A is a perspective view illustrating behaviors of the upper thread and the lower thread extending from the horizontal shuttle to the insertion hole of the feed dog during sewing following FIG. 6A.
Figure 7B:
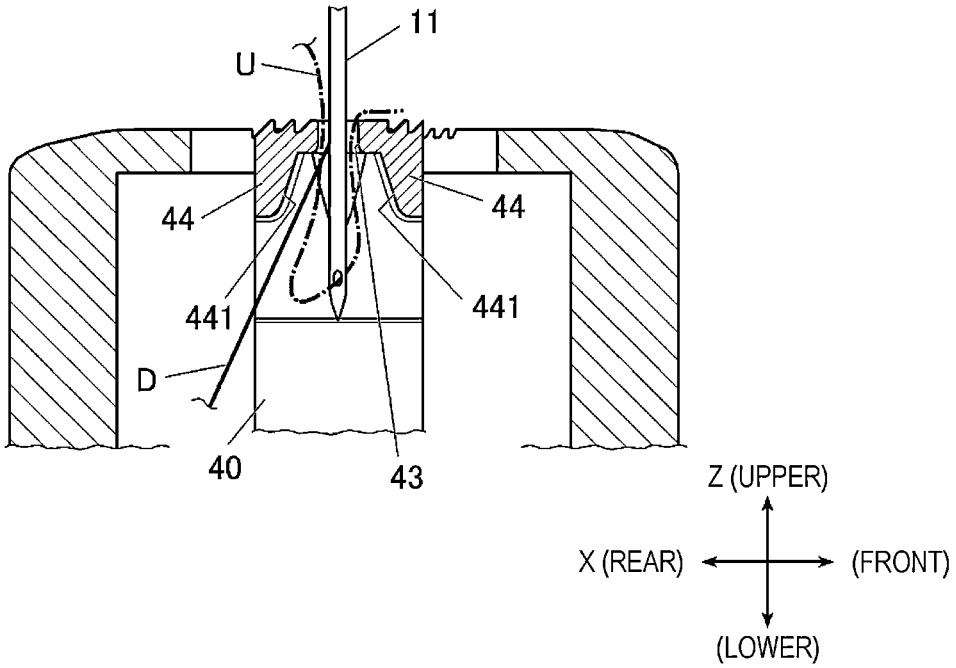
FIG. 7B is a cross-sectional view thereof as viewed from the lateral side.

Next, FIGS. 7A and 7B show a state in which the upper shaft angle is 203°. The upper shaft angle of 203° is a state in which the sewing needle 11 passed through a bottom dead center and starts to rise. The upper thread U starts to form a loop due to slack as the sewing needle 11 starts to rise below the insertion hole 43. Further, the hook 173 of the horizontal shuttle 17 is in a state immediately before the hook 173 captures the loop of the upper thread U.

The feed dog 40 is located in the vicinity of a middle position in the front and rear stroke range in the forward movement. The lower thread D extends straight from the lower thread feed port 174 to the insertion hole 43. The forward inclination of the lower thread D increases as the feed dog 40 moves forward, and the lower thread D approaches the inner side surface 441 on the lower thread feed port 174 side. However, since the inner side surface 441 is inclined forward and upward (rearward and downward), the inner side surface 441 maintains a non-contact state with the lower thread D.

Figure 8A:
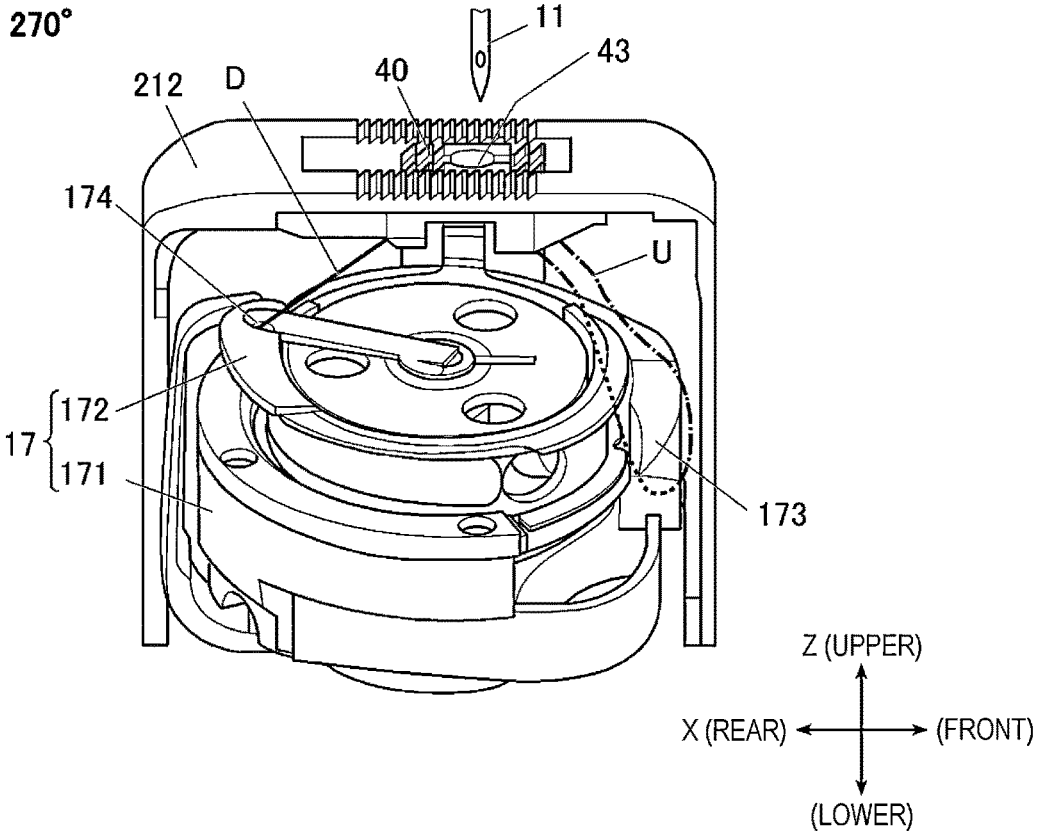
FIG. 8A is a perspective view illustrating behaviors of the upper thread and the lower thread extending from the horizontal shuttle to the insertion hole of the feed dog during sewing following FIG. 7A.
Figure 8B:
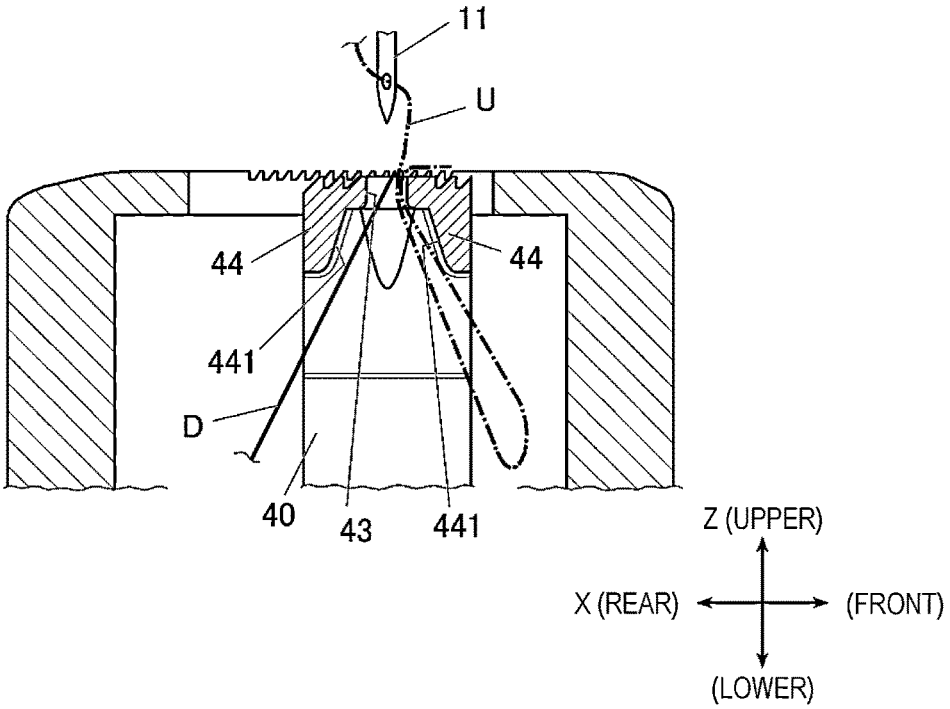
FIG. 8B is a cross-sectional view thereof as viewed from the lateral side.

Next, FIGS. 8A and 8B show a state in which the upper shaft angle is 270°. The upper shaft angle of 270° is a state in which the sewing needle 11 left the insertion hole 43 due to the upward movement thereof and the upper thread U is captured by the hook 173 of the horizontal shuttle 17 below the insertion hole 43 and is largely drawn to a side opposite to the lower thread D along an outer periphery of the inner shuttle 172.

The feed dog 40 is located at a most forward position in the front and rear stroke range, and the lower thread D approaches the inner side surface 441 on the lower thread feed port 174 side in a state in which the lower thread D extends straight from the lower thread feed port 174 to the insertion hole 43 and the forward inclination is largest. However, since the inner side surface 441 is inclined forward and upward (rearward and downward), the inner side surface 441 maintains a non-contact state with the lower thread D.

Figure 9A:
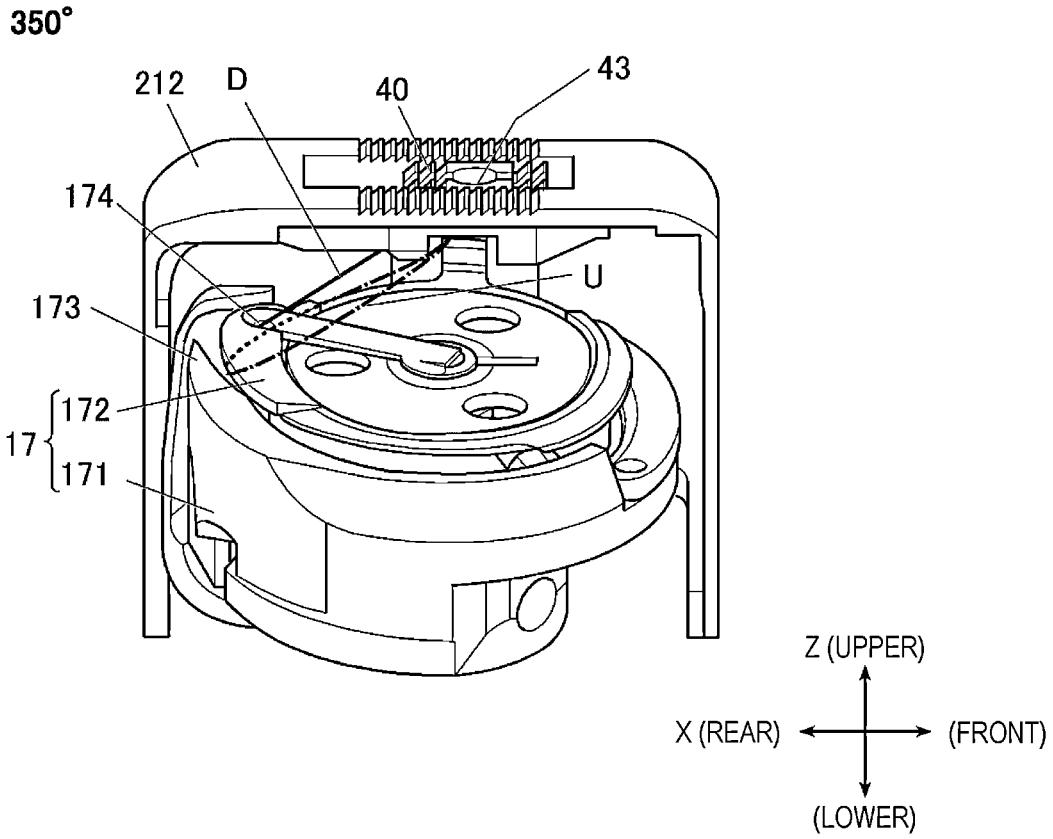
FIG. 9A is a perspective view illustrating behaviors of the upper thread and the lower thread extending from the horizontal shuttle to the insertion hole of the feed dog during sewing following FIG. 8A.
Figure 9B:
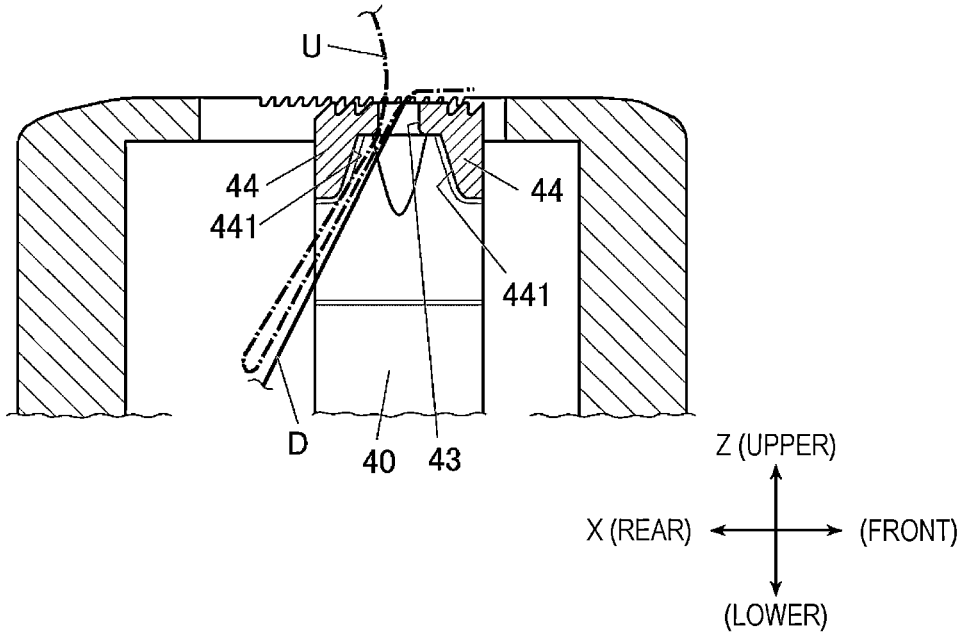
FIG. 9B is a cross-sectional view thereof as viewed from the lateral side.

Next, FIGS. 9A and 9B show a state in which the upper shaft angle is 350°. At the upper shaft angle of 350°, the sewing needle 11 is located substantially at the top dead center due to the upward movement, and the upper thread U is captured by the hook 173 of the horizontal shuttle 17 below the insertion hole 43 and is largely drawn to the lower thread D side along the outer periphery of the inner shuttle 172. Immediately thereafter, the loop of the upper thread U passes through the entire inner shuttle 172 and is released from the horizontal shuttle 17.

The feed dog 40 moves slightly downward from the most forward position in the front and rear stroke range, and the lower thread D approaches the inner side surface 441 on the lower thread feed port 174 side in a state in which the lower thread D extends straight from the lower thread feed port 174 to the insertion hole 43 and the forward inclination is reduced, and maintains the non-contact state.

Figure 10A:
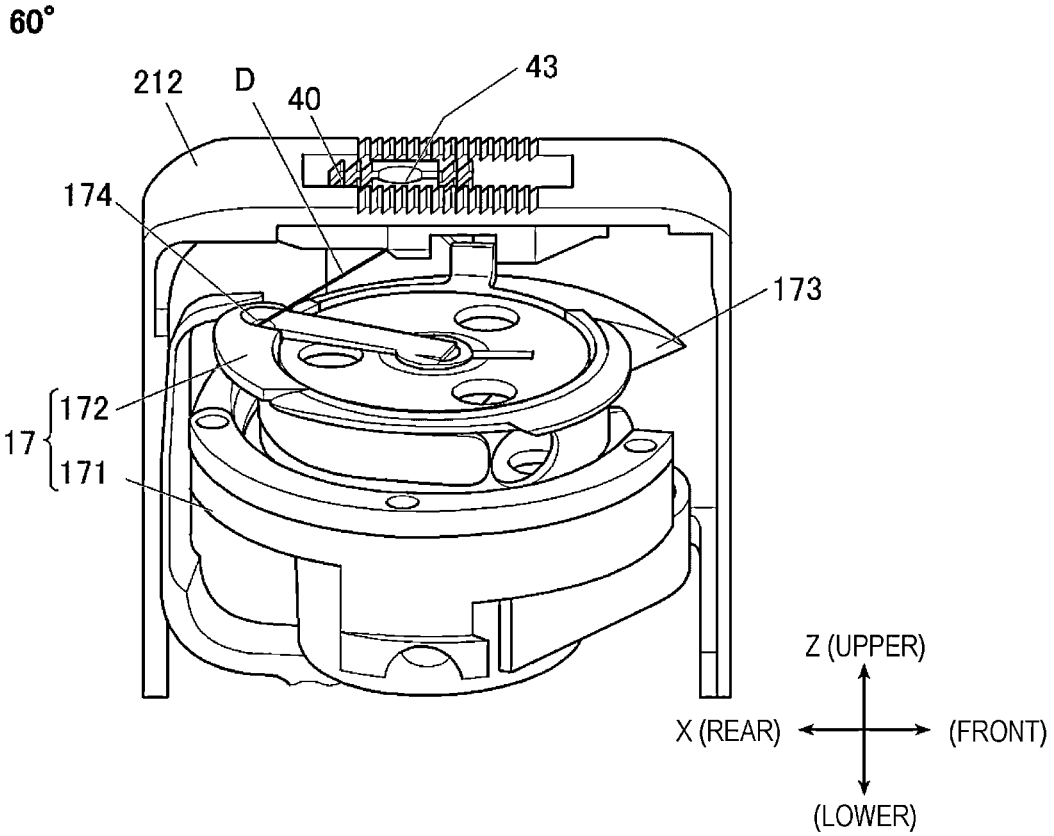
FIG. 10A is a perspective view illustrating behaviors of the upper thread and the lower thread extending from the horizontal shuttle to the insertion hole of the feed dog during sewing following FIG. 9A.
Figure 10B:
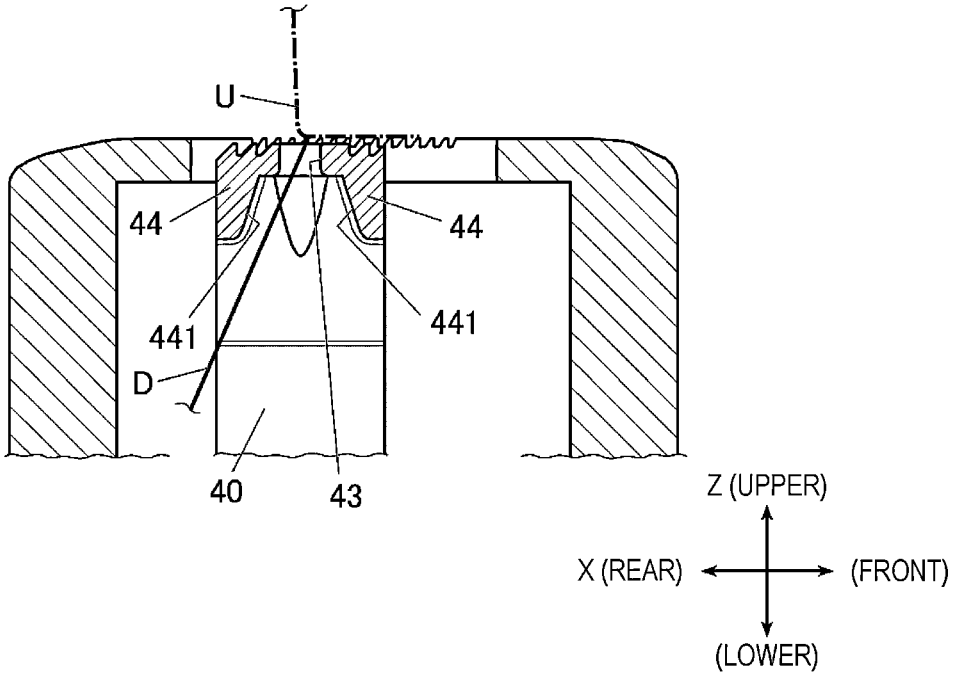
FIG. 10B is a cross-sectional view thereof as viewed from the lateral side.

Next, FIGS. 10A and 10B show a state in which the upper shaft angle is 60°. The upper shaft angle of 60° is a state in which the thread take-up lever fully draws up the upper thread U. Below the insertion hole 43, the loop of the upper thread U that was drawn to a maximum extent disappears due to the drawing of the thread take-up lever. On the other hand, the loop of the upper thread U is reduced at once from a state in which the lower thread D is inserted into the loop of the upper thread U, and thus the lower thread D is drawn up by the upper thread U to form a knot.

[Operations and Effects Based on Structure of Feed Dog]

In a series of hand movement and feed operation illustrated in FIGS. 6A to 10B, the upper thread U leaves the horizontal shuttle 17 immediately after the upper shaft angle exceeds 350°, and starts to be drawn up by the thread take-up lever. At this timing, the loop of the upper thread U is maximized and is likely to go into disorder. At this time, since the pair of wall portions 44 are provided at the front and rear portions on a lower side of the top plate 41 of the feed dog 40, the disorder of the loop of the upper thread U is prevented from moving forward and rearward even when the upper thread U goes into disorder.

Since the pair of wall portions 44 prevent the disorder of the loop of the upper thread U, it is not necessary to cut a corner portion of the top plate 41, and the contact area between the workpiece and the feed dog 40 can be sufficiently ensured. Accordingly, excellent seams can be formed while the workpiece is fed well.

Figure 11:
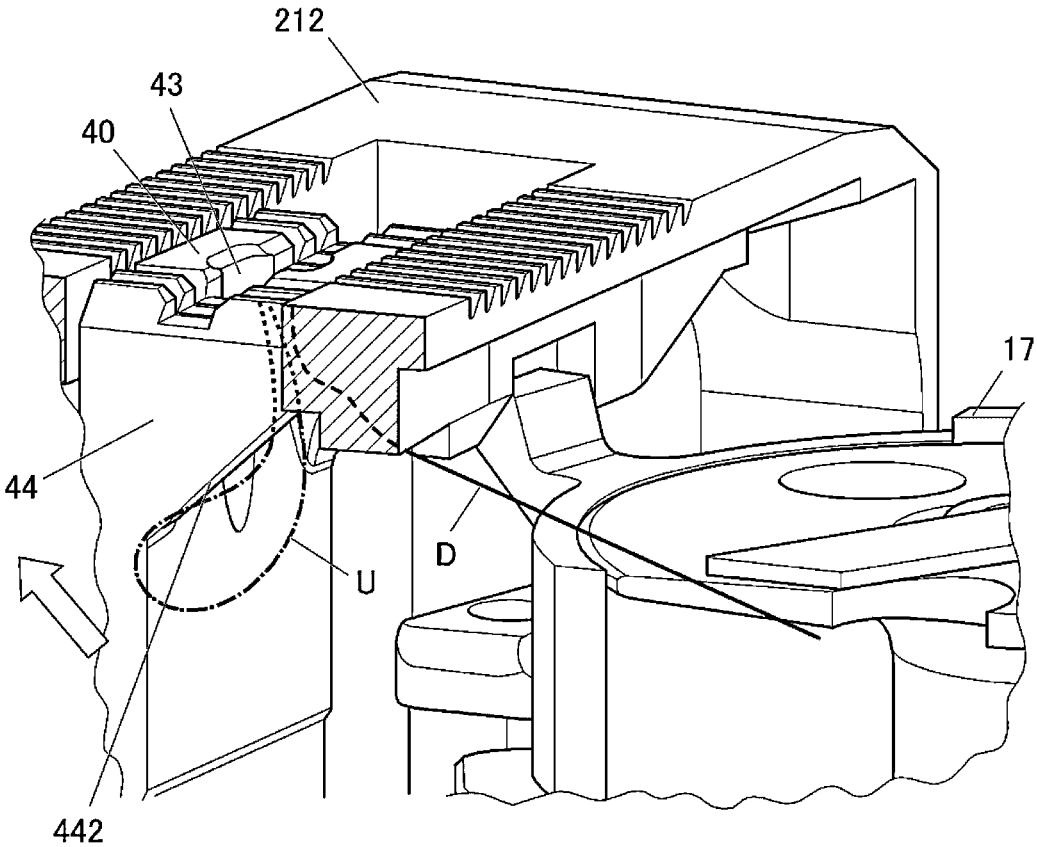
FIG. 11 is a perspective view illustrating a periphery of the feed dog by cutting out a part of the throat plate.
Figure 11:
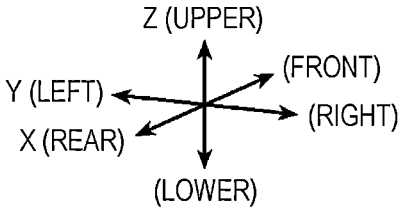

FIG. 11 is a perspective view illustrating the vicinity of the feed dog 40 by cutting out a part of the throat plate 212.

As illustrated in the drawing, as described above, each of the pair of wall portions 44 has, at the lower portion of each end portion in the Y-axis direction (width direction of the top plate 41), the inclined surface 442 that is inclined inward in the Y-axis direction (support portion 42 side) and downward.

When the pair of wall portions 44 are provided and the loop of the upper thread U goes into disorder in the direction of an arrow in FIG. 11, the upper thread U may be caught by the lower end portion of the wall portion 44, and sewing failures such as sewing unevenness and bunches (loops of the upper thread remaining due to a drawing failure of the thread take-up lever) may occur. However, when the inclined surface 442 is formed at the lower end portion of the wall portion 44, the catching can be prevented, sewing failures can be reduced, and excellent seams can be formed.

In particular, when a lower end portion of the inclined surface 442 reaches the support portion 42, no corner portion is formed at the lower end portion of the wall portion 44, and thus the loop of the upper thread U can be more effectively prevented.

The inclined surface 442 further has a function of guiding the upper thread U to the insertion hole 43 while preventing the upper thread U from being caught when the loop of the upper thread U is drawn up by the thread take-up lever, so that the upper thread U can be drawn up smoothly. Therefore, seams can be formed in accordance with the set tension and the sewing quality can be improved.

When the sewing machine 100 is a post-bed sewing machine, the internal space of the post bed 211 is narrow, and thus it is required to reduce the size of the feed dog 40 in the X-axis direction (feed direction). However, when the feed dog 40 is reduced in size in the X-axis direction, the loop of the upper thread U is likely to be caught on the corner portion of the top plate 41 and the lower end portions of the pair of wall portions 44. However, the pair of the wall portions 44 can effectively prevent the catching of the upper thread U on the corner portion of the top plate 41, and the inclined surface 442 can effectively reduce the catching of the upper thread U on the lower end portions of the pair of wall portions 44.

The case in which the sewing machine 100 is a post-bed sewing machine is described as an example. When the sewing machine 100 is a cylinder bed sewing machine, an upper surface of a cylinder bed is similarly narrow and a reduction in size in the feed direction of the feed dog is required. Accordingly, the feed dog 40 having the above-described configuration can also be suitably applied to the cylinder bed sewing machine.

The shuttle mechanism of the sewing machine 100 includes the horizontal shuttle 17. In a so-called vertical shuttle, a rotary circle of the shuttle is disposed along the vertical direction, and is disposed below the needle hole and the insertion hole. Accordingly, the direction in which the loop of the upper thread U released from the hook of the shuttle is directed toward an eye and the insertion hole coincides with the drawing-up direction by the thread take-up lever, and thus the disorder of the loop of the upper thread U is less than in the horizontal shuttle.

In contrast, a rotary circle of the horizontal shuttle 17 is disposed along the horizontal direction, and the loop of the upper thread U is captured and released from a lateral side (Y-axis direction) relative to the insertion hole 43. For this reason, the direction in which the loop of the upper thread U released from the hook of the shuttle is directed toward the insertion hole 43 is the Y-axis direction, which does not coincide with the drawing-up direction by the thread take-up lever that is the Z-axis direction. Accordingly, the disorder of the loop of the upper thread U is more likely to occur than in the vertical shuttle.

However, since the feed dog 40 includes the pair of wall portions 44 and each of the wall portions 44 has the inclined surface 442, the loop of the upper thread U can be prevented from being caught and the sewing quality can be improved.

In the series of hand movement and feed operation, the lower thread D maintains a state of extending linearly from the lower thread feed port 174 to the insertion hole 43. On the other hand, since the feed dog 40 having the insertion hole 43 performs the feeding by the front-and-rear and up-and-down revolving operation, the inclination angle of the lower thread D constantly fluctuates.

In contrast, the wall portion 44 of the feed dog 40 is inclined in a front-and-rear direction (X-axis direction) in which the inner side surface 441 is separated from the insertion hole 43 as approaching downward. As seen from the insertion hole 43 side, the lower thread D extends in a direction away from the insertion hole 43 as approaching downward, similarly to the inclination direction of the inner side surface 441. Accordingly, the inner side surface 441 along the inclination direction can reduce the contact with the lower thread D.

In particular, by setting an inclination component of the inner side surface 441 in the front-and-rear direction to be equal to or larger than an inclination component of the lower thread D in the front-rear direction that may occur (increasing the inclination in the front-rear direction), the contact with the bobbin thread D can be more effectively prevented.

When the lower thread D can be prevented from coming into contact with the feed dog 40 in the series of hand movement and feed operation, the variation in the tension of the lower thread D during sewing is reduced. Then, seams formed by the sewing are homogenized, and the effect of improving the sewing quality is expected.

As illustrated in FIG. 5, it is preferable that a length L in the X-axis direction (feed direction) from the center of the insertion hole 43 of the feed dog 40 to a lower end portion of the inner side surface 441 is ½ or more of a maximum pitch that can be set by the feed adjustment mechanism relative to the feed mechanism.

A length 1 in the X-axis direction from the center of the insertion hole 43 of the feed dog 40 to an upper end portion of the inner side surface 441 is preferably ¼ or more of the maximum pitch. In this case, the length 1 to the upper end portion of the inner side surface 441 is preferably smaller than the length L to the lower end portion.

Even when the feed pitch of the feed dog 40 is set to the maximum, the lower thread D extending from the lower thread feed port 174 to the insertion hole 43 can be prevented from coming into contact with the inner side surface 441.

The sewing machine 100 is a needle-feed sewing machine including a needle-feed mechanism that reciprocates the needle bar 12 in the X-axis direction in synchronization with the feed dog 40, and is also a unison-feed sewing machine including the feed foot 14 that applies a feed operation to the workpiece on the throat plate 212 from above in synchronization with the feed dog 40.

In the case of the needle-feed sewing machine and unison-feed sewing machine, no eye is formed in the throat plate 212, an opening through which the top plate 41 of the feed dog 40 is exposed is formed, and the insertion hole 43 that is a needle hole is formed in the feed dog 40.

In this case, the position and behavior of the lower thread D inserted into the insertion hole 43 vibrate back and forth below the top plate 41 by the reciprocating front-and-rear movement of the feed dog 40, and the lower thread D is likely to come into contact with the wall portion 44 of the feed dog 40. However, since the wall portion 44 has the inclined inner side surface 441, the contact with the lower thread D is prevented, and the tension fluctuation of the lower thread D is effectively reduced in the needle-feed sewing machine and unison-feed sewing machine. Then, an effect of suitably improving the sewing quality by homogenization of seams is expected.

[Others]

The embodiment of the present invention is described above. However, the present invention is not limited to the above-described embodiment.

For example, although a double-needle sewing machine is described as an example of the sewing machine 100, the sewing machine 100 is not limited thereto, and may be a single-needle sewing machine. In this case, the feed dog 40 may be divided into two in a middle position in the Y-axis direction by a division cross section along the X-Z plane.

Although the inner side surface 441 inclined in the predetermined direction is formed on both of the front and rear wall portions 44, the inclined inner side surface 441 may be provided only on the wall portion 44 on the lower thread feed port 174 side of the horizontal shuttle 17.

Although the post-bed sewing machine is described as an example of the sewing machine 100, the present invention can be applied to any sewing machine as long as the sewing machine feeds a workpiece by a feed dog. For example, the present invention is not limited to the cylinder bed described above, and the feed dog 40 including the wall portion 44 may be provided in a flat bed sewing machine. Also in the case of the flat bed sewing machine, the loop of the upper thread U may go into disorder. Accordingly, it is effective to provide the pair of wall portions 44 below the feed dog 40, and the inclined surface 442 is also effective. The inner side surface 441 is also effective to prevent the contact with the lower thread D.

In the case of the flat bed sewing machine, the support portion 42 of the feed dog 40 may not have a plate-shaped structure along the X-Z plane. For example, the support portion 42 may be coupled to a feed dog bracket to which a front-and-rear and up-and-down reciprocating movement is input. In this case, the support portion 42 may have a plate shape along the X-Y plane. The feed dog 40 may have a configuration in which the plate-shaped support portion 42 along the X-Y plane is coupled with the top plate 41.

The unison-feed sewing machine is described as an example of the sewing machine 100, and the sewing machine 100 is not limited thereto. The present invention is also applicable to a sewing machine that does not have an upper feed mechanism and/or a needle-feed mechanism. In this case, the insertion hole of the feed dog is not a circular hole as the insertion hole 43, but may be a rectangular opening or a slit having a larger opening, and an eye may be provided in the throat plate separately from the feed dog.

However, even in the case of such a sewing machine, the loop of the upper thread U may go into disorder, and thus it is effective to provide the pair of wall portions 44 below the feed dog, and the inclined surface 442 is also effective. Since the feed dog performs a revolving operation along the front-and-rear direction, the inner side surface 441 is also effective to prevent the contact with the lower thread D.

Although the shuttle mechanism of the sewing machine 100 includes the horizontal shuttle as an example, the shuttle mechanism is not limited thereto, and the shuttle may be a vertical shuttle. The shuttle is not limited to a full rotary shuttle, and may be a half rotary shuttle.

Even in these cases, the loop of the upper thread U may go into disorder, and thus it is effective to provide the pair of wall portions 44 below the feed dog 40, and the inclined surface 442 is also effective. Since the feed dog 40 performs a revolving operation along the front-and-rear direction, the inner side surface 441 is also effective to prevent the contact with the lower thread D.

What is claimed is:

1. A sewing machine comprising:

a feed dog partially protruding out up and down from a throat plate to feed a workpiece;

a sewing needle configured to perform stitch points on the workpiece by moving up and down; and a shuttle configured to capture an upper thread passed through the sewing needle below the throat plate to be entwined with a lower thread, wherein the feed dog includes:

a top plate having teeth formed on an upper surface thereof, and a support portion to which a feed operation relative to the top plate is input, and wherein the top plate includes:

an insertion hole that the sewing needle penetrates up and down, a pair of wall portions extending in an up-and-down direction respectively on one side and another side in a feed direction of the workpiece relative to the insertion hole on a lower surface side of the top plate, each wall portion on a lower thread feed port side of the shuttle of the pair of wall portions has an inner side surface on an insertion hole side inclined in a direction away from the insertion hole as approaching downward, and the inner side surface is separated from an inner wall of the insertion hole as approaching downward.

2. The sewing machine according to claim 1, wherein each of the pair of wall portions has, at a lower portion of an end portion of the top plate in a width direction, an inclined surface inclined inward in the width direction as approaching downward.

3. The sewing machine according to claim 1, further comprising:

a needle-feed mechanism configured to reciprocate a needle bar holding the sewing needle in the feed direction of the workpiece in synchronization with the feed dog.

4. The sewing machine according to claim 1, further comprising:

a feed foot configured to apply a feed operation to the workpiece on the throat plate from above in synchronization with the feed dog.

5. The sewing machine according to claim 1, wherein the shuttle is a horizontal shuttle.

* * * * *